United States Patent [19]

Lauder

[11] Patent Number: 4,979,841

[45] Date of Patent: Dec. 25, 1990

[54] MEMBER FOR SHEET BINDING STAPLE

[76] Inventor: John A. Lauder, 5 Riverside Dr., Apt. 1002, Binghampton, N.Y. 13905

[21] Appl. No.: 445,267

[22] Filed: Dec. 4, 1989

[51] Int. Cl.[5] ..... B42F 13/00

[52] U.S. Cl. ..... 402/15; 402/60; 402/64; 402/68; 402/80 R

[58] Field of Search ..... 402/15, 80 R, 60, 64, 402/65, 66, 68

[56] References Cited

U.S. PATENT DOCUMENTS

| | | | |
|---|---|---|---|
| 2,012,572 | 8/1935 | Linsky | 402/15 |
| 2,013,097 | 9/1935 | Hanna | 402/15 |
| 2,184,276 | 12/1939 | Brennan | 402/15 |
| 2,314,532 | 3/1943 | Wagner | 402/15 |
| 4,305,675 | 12/1981 | Jacinto | 402/15 |

FOREIGN PATENT DOCUMENTS

| | | | |
|---|---|---|---|
| 2643006 | 4/1977 | Fed. Rep. of Germany | 402/15 |

*Primary Examiner*—Hien H. Phan
*Assistant Examiner*—H. S. Payer
*Attorney, Agent, or Firm*—Kenneth P. Johnson

[57] ABSTRACT

Retainer element for releasably inhibiting movement of a restraining clip along a clinched blade end of a staple used to bind one or more pieces of sheet material. The element is wedge-shaped, inexpensively formed and inserted between the clinched blade end and a yoke or between the blade end and its restraining clip to frictionally prevent movement of the clip during transport and storage of the bound sheets.

20 Claims, 1 Drawing Sheet

MEMBER FOR SHEET BINDING STAPLE

BACKGROUND OF THE INVENTION

This invention relates generally to retainers for releasably binding sheets of material into groups and, more particularly, to implements for retaining clinched retainer ends in position.

A commonly used technique for securing one or more sheets of material, such as paper, in a file folder is to insert the upstanding ends of a U-shaped retainer through pairs of aligned holes in the folder, the paper sheets and a clamping rail-like keeper or clasp, then clinching the retainer blade ends protruding through the sheets and keeper, maintaining the bent ends in clinched position by holding clips captive on the keeper or clasp and movable therealong. Sheets are added or removed by sliding the clips to free the clinched blade ends, straightening the blade ends, removing the keeper and sheet, thereafter replacing the keeper, re-clinching the ends and repositioning the clips to secure the ends. The retainer ends can easily withstand repeated bending and straightening.

Although an inexpensive and popular binding device, the clinchable blade retainer has the disadvantage that the holding clips are relatively loose and slide freely, even expanding with use, allowing unwanted displacement of the clip along the keeper, thereby permitting one or both of the retainer ends to lift from the restrained and clinched position adjacent to the clasp. On occasion one or both ends lift, permitting release or loosening of the sheets. The inconvenience increases as the retainer becomes filled to capacity with a larger number of sheets.

Frequently, these retainers are inserted in opposing sides of a folder to bind two facing groups of sheets. When the clips loosen and slide off one or both of the clinched ends of opposite blades in a closed folder, the blades may become entangled with their opposed counterparts or the ends of one retainer blade may become secured under a clip of an opposite blade as the folder is repositioned, tilted or stored. Separation then becomes difficult, frustrating, and time consuming.

OBJECTS AND SUMMARY OF THE INVENTION

It is accordingly a primary object of this invention to provide means for inhibiting unwanted movement of slideable clips used to maintain the ends of sheet binding retainers in their clinched position.

It is a further object of this invention to provide easily releasable means for inhibiting movement of clips in which the releasable means are selectively adjustable to that force necessary to maintain the position of the clinched ends of retainers used to bind sheet material.

It is another important object of this invention to provide removable, inexpensive, easily formed devices for restricting movement of retention clips for clinched ends of releasable retainers used to bind sheets of materials.

Yet another object of this invention is to provide a wedge-shaped device having a high coefficient of friction so that it remains in place when inserted between a holding clip and clinched retainer end or between the retainer, end and clamping keeper on a releasable binding retainer for sheet material when the clip is positioned to restrict release of the clinched end of the retainer.

The foregoing objects of this invention are attained in accordance with the invention by providing releasable inhibiting means for clip motion in the form of a wedge-shaped member that can be inserted between a flexible, clinched blade of a binding retainer for sheet material and the clip uscd for holding the blade in its clinched, deformed configuration. The wedge retaining member provides frictional retention against clip motion and has a flange about at least a portion of its butt or large end to facilitate insertion and removal of the wedge-member. The member is preferably inexpensively constructed of a flexible, resilient material having a surface with a relatively high coefficient of friction. However, metal or wooden wedge members also may be used and function well.

A user maintains a supply of the small wedge-shaped retaining members at a desk in a manner similar to paper clips and inserts a wedge retainer as necessary. Each inserted wedge member provides a varying thickness or choice of thicknesses to conform to the degree of clip looseness and prevents the restraining clip, deformed or not, from sliding during transport, tilting or storage of its file folder. The wedges are formed in various sizes and of various non-corrosive, durable materials.

The foregoing and other objects, features and advantages of the invention will be apparent from the following more particular description of preferred embodiments of the invention considered in conjunction with the accompanying drawing.

DESCRIPTION OF THE PREFERRED EMBODIMENTS

Figure 1:
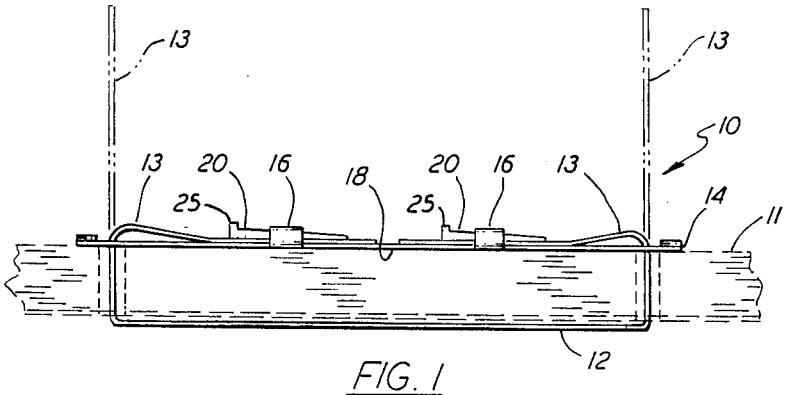
FIG. 1 is an elevation view, partly in section, of a clinched retainer with keeper and retainer blade restrain-clips for securing a plurality of sheets and incorporating retaining members in accordance with the principles of the invention.
Figure 2:
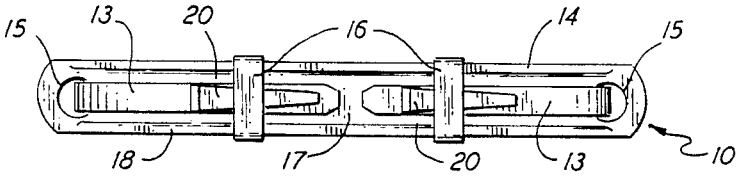
FIG. 2 is a plan view of the retainer, keeper, clips and retaining members shown in FIG. 1.

Referring to FIGS. 1 and 2, there is shown a binding retainer, generally designated 10, for securing a plurality of sheets, usually paper, in an orderly stack 11. The sheet retainer is typically formed of thin metal that can withstand repeated flexing and is initially U-shaped with base portion 12 having an integral, upstanding, sheet-piercing blade 13, shown in phantom, at either end of the base. A keeper-type link 14 has an opening 15 at each end to receive a respective blade therethrough. The keeper is placed on the sheet stack over the blades whose excess length extending beyond the keeper is then bent or clinched onto the keeper to hold the keeper tightly against the stack. Keeper 14 carries a pair of restraining or holding clips 16, captively mounted but movable along the keeper to slide over the clinched free end of a respective depressed blade end to maintain the blade in its depressed and deformed position. Base portion 12 and keeper 14 can each be formed with a shallow longitudinal recess or channel 17 having a width somewhat greater, but approximately equal to that of the blades. The channel adds resistance to bending, compact nesting of base and keeper for shallow stacks and, in the case of the keeper, can provide at its edges guide track 18 for defining the movement of retaining clips 16. For sheet removal, the clips are both appropriately slid to free their respective blade ends which are moved to an upright or the phantom position of FIG. 1 to enable keeper removal.

Clips 16 tend to slide freely as the position of the sheet stack and retainer is tilted or changed. This unwanted movement releases one or both of the suppressed blades allowing the stack to loosen. Furthermore, in the situation where two binding retainers and their stacks face each other, as when installed on opposite sides of a file folder, a clip on one keeper.. may inadvertently move onto a blade of the facing retainer, thus locking the folder closed.

Figure 3A:
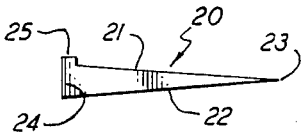
FIGS. 3*a* and 3*b* are elevation and plan views respectively, of a preferred retaining member for use with the retainer, keeper and clips of FIG. 1.
Figure 3B:
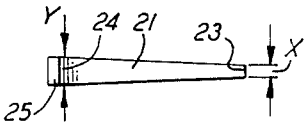

The frequency of the foregoing difficulties and annoyances is reduced and even eliminated by inserting a device having variable thickness, such as a wedge-shaped member 20, between the underside of clips 16 and their depressed blades 13 or between blades 13 and keeper 14 to retain the clips in position. Examples of suitable wedge members are shown in FIGS. 3–5. FIGS. 3*a* and 3*b* show a preferred form of retainer 20 that is wedge-shaped with opposite major surfaces 21, 22 diverging from a knife-like edge or tip 23 at identical angles from the longitudinal axes toward butt 24. Member 20 is inserted so that its major surfaces 21, 22 engage the underside of a holding clip 16 and depressed blade 13 being restrained or engage the underside of blade 13 and upper surface of keeper 14. The wedge member can be inserted on the surface of the blade from either the attached or free end of the blade and is pushed into position with force sufficient to remain in that position. The amount of force will be learned from experience and may vary since the clip resistance to deformation and expansion varies with its material or manufacturer. Member 20 can be used with either surface 21 or 22 engaging the clip or blade or engaging the blade or keeper.

Wedge member width is approximately equal to that of the blade, and can be uniform, but is preferably tapered slightly, being narrower at thin tip 23 than at butt 24; that is, dimension x is less than dimension y in FIG. 3*b*. Each wedge is formed with a flange 25 at its butt to facilitate removal with the fingers when freeing the clip for blade release. Wedge 20 is inserted so that flange 25 is easily accessible and extends upwardly from its blade or clip to enable extraction. However, the flange may be placed on both major surfaces 21 and 22 or may even extend beyond all longitudinal wedge surfaces at the wedge butt.

Figure 4A:
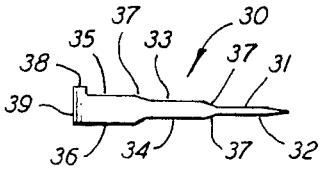
FIGS. 4*a*, 4*b*, 5*a* and 5*b* are respectively pairs of elevation and plan views of alternative embodiments of retaining members that can be used with the retainer, keeper and clips of FIG. 1.
Figure 4B:
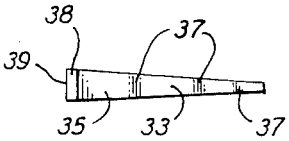
Figure 5A:
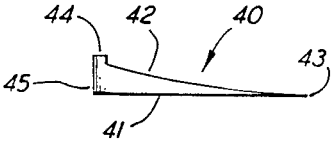
Figure 5B:
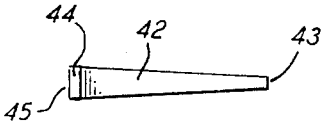

FIGS. 4*a*, 4*b*, 5*a* and 5*b* illustrate alternative embodiments of wedge retainers. In FIGS. 4*a* and 4*b*, retainer 30 has opposite major surfaces that comprise a series of pairs of parallel surfaces 31,32; 33,34; 35,36; with each pair at greater distance from the longitudinal wedge axis and interconnected by angular surfaces 37. A flange 38 extends outwardly from either surface 35 or 36 to form the butt 39. The width of member 30 is preferably as described with respect to member 20 of FIG. 3. An obvious modification can be made by forming one major surface as a single plane and the other as a series of distinct flat surfaces 31,33 and 35. In FIGS. 5*a* and 5*b*, the opposite major surfaces of wedge retainer, 40 engaging the clip and blade or blade and keeper comprise a flat, uncurved surface 41 and curved surface 42 varying nonlinearly from the longitudinal axis of the wedge as they extend from tip 43 to flange 44 at butt 45.

It will be apparent that the wedge profile can be altered to many configurations to provide a variable retention force as necessary or desired to meet the conditions and strength of the blade-holding clips. The angles of the major wedge surfaces with respect to the longitudinal axis need not be identical but can vary widely. Also, the flanoe location and size is an option of convenience for removal of the wedge. The wedge member can be fabricated of metals, wood or plastic materials. The plastics offer a wide range of surface durabilities, resilience, and coefficients of friction to remain in place under the clips or retainer blades. The plastics can also be inexpensively manufactured by molding. The wedge members are contemplated as being a common desk item, similar to paper clips. A user would maintain a supply of wedge members, inserting the wedges as necessary to prevent displacement of the sliding clips and thereby achieve greater convenience and improved integrity of paper files so necessary for record retention.

While the invention has been particularly shown and described with reference to preferred embodiments thereof, it will be understood by those skilled in the art that the foregoing and other changes in form and details may be made therein without departing from the spirit and scope of the invention.

What is claimed is:

1. A fastener for securing a plurality of sheets together comprising:

sheet retainer means having a base portion and balde means extending from at least one end thereof;

keeper means having at least one opening therethrough for the passage of said blade means and having clip means thereon for sliding along said keeper means to maintain said blade means in a depressed position; and a wedge-shaped member being insertable adjacent to said blade means for restricting movement of said clip means along said keeper means.

2. The fastener as described in claim 1 wherein said blade means comprises a pair of blade means extending from opposite ends of said base portion, each interconnecting with said keeper means through a respective opening therein, and said keeper means carries a pair of clip means slidable therealong to retain a respective blade means in said depressed position and one or more wedge-shaped members insertable adjacent to said blade means for restricting movement of a said clip means.

3. The combination as described in claim 1 wherein each said wedge-shaped member includes a pair of opposite surfaces diverging from each other from a tip to a butt and said wedge-shaped member includes gripping flange means at said butt to facilitate removal of said wedge-shaped member.

4. The combination as described in claim 3 wherein said pair of surfaces diverge uniformly with respect to a longitudinal axis of said wedge-shaped member.

5. The combination as described in claim 3 wherein at least one of said pair of surfaces diverges nonlinearly with respect to a longitudinal axis of said wedge-shaped member.

6. The combination as described in claim 1 wherein said wedge-shaped member includes at least one generally divergent surface thereof that has a series of intermediate smaller surface portions each at a different distance from a longitudinal axis of said wedge-shaped member.

7. In a device having a movable clip overlying and restraining a blade end of a sheet retainer in a depressed position on a keeper, a member for restricting movement of said clip comprising:

an element having a tip and a butt joined by opposite, increasingly separated, major surfaces and being insertable between said clip and said depressed blade; and means at said butt extending beyond the periphery of said element for providing a gripping flange for applying force to said element for removal thereof.

8. The element as described in claim 7 wherein the width of said opposite surfaces increases as they approach said butt.

9. The element as described in claim 7 wherein the width of said element is approximately equal to the width of said blade.

10. The element as described in claim 7 wherein at least one of said opposite surfaces diverges linearly with respect to said other major surface.

11. The element as described in claim 7 wherein said flange means is integral with said element.

12. The element as described in claim 7 wherein at least one of said two opposite surfaces includes a series of smaller intermediate surface areas each at a longitudinal axis of said element.

13. The element as described in claim 7 wherein said opposite major surfaces diverge linearly from the longitudinal axis of said element from said tip to said butt.

14. The element as described in claim 7 wherein said element is formed of moldable material.

15. The element as described in claim 14 wherein said material is a polymer.

16. The element as described in claim 14 wherein said material is a metal.

17. The element as described in claim 14 wherein said material is wood.

18. In a fastener having a movable clip overlying and restraining a blade end of a sheet retainer in a depressed position on a keeper, a member for restricting movement of said clip comprising:

an element having a tip and a butt interconnected by one or more pairs of opposite, planar, differentially spaced surfaces therebetween with the tip of said element being insertable a variable distance such that a pair of said surfaces engage said clip and said depressed blade to frictionally restrain said clip from movement along said keeper.

19. The element as described in claim 18 wherein said element is constructed of a moldable material.

20. The element as described in claim 18 wherein said element has flange means at said butt end.

* * * * *